US007833024B2

(12) United States Patent
Takeuchi et al.

(10) Patent No.: US 7,833,024 B2
(45) Date of Patent: Nov. 16, 2010

(54) BOARD-TO-BOARD CONNECTOR FOR MOUNTING ON A CIRCUIT BOARD

(75) Inventors: Ryotaro Takeuchi, Kanagawa (JP); Tomonari Kaneko, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/989,703

(22) PCT Filed: Aug. 3, 2006

(86) PCT No.: PCT/US2006/030620

§ 371 (c)(1),
(2), (4) Date: Mar. 9, 2009

(87) PCT Pub. No.: WO2007/016706

PCT Pub. Date: Feb. 8, 2007

(65) Prior Publication Data

US 2009/0318029 A1 Dec. 24, 2009

(30) Foreign Application Priority Data

Aug. 3, 2005 (JP) ..... 2005-224859

(51) Int. Cl.
*H01R 12/00* (2006.01)

(52) U.S. Cl. ..... 439/74

(58) Field of Classification Search ..... 439/74, 439/65

See application file for complete search history.

(56) References Cited

U.S. PATENT DOCUMENTS 5,975,916 A 11/1999 Okura (Continued)

FOREIGN PATENT DOCUMENTS

WO WO 2004/042874 A1 5/2004

OTHER PUBLICATIONS

International Search Report for PCT/US2006/030620.

(Continued)

*Primary Examiner*—Gary F. Paumen
(74) *Attorney, Agent, or Firm*—Timothy M. Morella

(57) ABSTRACT

A board-to-board connector for mating with another connector has a housing and a plurality of terminals. The terminals and housing interact at a reference surface to accurately locate the terminals relative to the housing. The housing includes an elongated recess that extends parallel to a longitudinal axis of the housing and has a plurality of terminal receiving cavities spaced therealong. Each cavity includes a terminal retention wall with a reference surface on one side thereof and a terminal alignment opening extending from the cavity. Each terminals is disposed in a terminal receiving cavity. Each terminal includes a U-shaped retention portion, an L-shaped resilient contact portion extending from the U-shaped retention portion and has a contact projection thereon. A tail portion for interconnection to a circuit member is also provided. The U-shaped retention portion includes first and second spaced apart legs and a connecting portion therebetween with the U-shaped retention portion dimensioned to securely receive the terminal retention wall of the housing between the spaced apart legs. The first leg is positioned along and engages the reference surface in order to accurately position the terminal within the terminal receiving cavity, and a terminal alignment projection extends from the U-shaped retention portion and projects into the terminal alignment opening to further position and secure the terminal within the cavity.

16 Claims, 3 Drawing Sheets

U.S. PATENT DOCUMENTS

| | | | |
|---|---|---|---|
| 6,135,785 | A | 10/2000 | Niitsu |
| 6,257,900 | B1 | 7/2001 | Huang et al. |
| 6,464,515 | B1 | 10/2002 | Wu |
| 6,623,308 | B2 | 9/2003 | Ono |
| 6,729,890 | B2 | 5/2004 | Shin |
| 6,764,314 | B1 | 7/2004 | Lee |
| 6,793,506 | B1 | 9/2004 | Hirata et al. |
| 6,827,588 | B1 | 12/2004 | Huang et al. |
| 6,884,089 | B2 | 4/2005 | Obikane et al. |
| 6,976,853 | B2 | 12/2005 | Goto |
| 7,037,117 | B2 | 5/2006 | Goto |
| 7,384,274 | B1 * | 6/2008 | Chen et al. ..... 439/74 |
| 2004/0142586 | A1 | 7/2004 | Yu |

OTHER PUBLICATIONS

International Search Report and Written Opinion for PCT Patent Application No. PCT/US2006/0030620, Published on Dec. 1, 2007.

* cited by examiner

BOARD-TO-BOARD CONNECTOR FOR MOUNTING ON A CIRCUIT BOARD

BACKGROUND OF THE INVENTION

1. Field of the Invention

The present invention relates to board-to-board connectors.

2. Description of the Related Art

Conventionally, board-to-board connectors may be used to electrically connect two parallel circuit boards together. Such board-to-board connectors are configured as a mating pair of connectors each of which are attached to and project from mutually facing surfaces of two circuit boards.

FIG. 6 is a cross section of one such conventional board-to-board connector. Reference numeral 301 denotes a first connector that is mounted on a first circuit board (not shown). The first connector 301 is mated and connected with a second connector (not shown) that is mounted on a second circuit board (not shown), whereby the conductive circuits on the first and second circuit boards are electrically connected to each other. The first connector 301 includes a plurality of terminals 302 that engage counterpart terminals of the second connector.

Each of the terminals 302 has a retention portion 308 secured to an inner surface of the housing of the first connector 301 and an intermediate portion 303 connected to the retention portion 308 and extending along an outer surface of the housing. The retention portion 308 and the intermediate portion 303 engage a portion of the housing, whereby each terminal 302 is held within the first connector 301. A retention barb 309 is formed on the retention portion 308. The retention barb 309 bites or skives into the housing which increases the force holding the terminal 302 within the housing. A tail portion 304 of the terminal 302 is soldered to a corresponding conductive circuit on the surface of the first circuit board.

A contact beam 305 is connected to the retention portion 308, and extends in a direction away from the intermediate portion 303. The contact beam 305 has a generally L-shape, and includes a contact projection 306 formed at its end. When the first connector 301 is mated with the second connector (not shown), the counterpart terminals of the second connector enter recess portions 307 of the first connector 301 and the contact projection 306 of each first terminal comes into contact with a contact portion of the corresponding counterpart terminal of each second connector, whereby the conductive circuits of the first and second circuit boards are electrically connected.

In the conventional board-to-board connector pair, each terminal 302 is fixed to the housing of the first connector 301 by means of the retention portion 308 and the intermediate portion 303. Since the retention portion, from which the contact projection 306 extends, bites or skives into the housing, and the depth of the skiving cannot be easily controlled, the location of the contact projection 306 with respect to the housing may not be located consistently resulting in the first connector having relatively poor dimensional accuracy. More specifically, the inwardly facing surface of recess 307 is used as a reference surface or datum and the contact beam 305 and contact projection 306 are positioned relative thereto. However, since the retention barb skives into the housing along the inwardly facing surface of recess 307 and such skiving may not be consistent, the positioning of barb 308 and thus contact beam 305 and contact projection 306 may not be consistent within the housing. Thus, even if the dimensional accuracy of the contact beam 305 of the terminal 302 were high, the position of the contact beam 305 and the contact projection 306 in relation to the housing is difficult to maintain, which may result in difficulty in properly mating the first connector 301 with the second connector.

Furthermore, when unmating the second connector from the first connector 301, an upward force acts on the contact projection 306. Since this upward force creates a rotational moment on the contact beam 305, it places a force on the retention portion 308 and the retention barb 309 which may separate the terminal from the inwardly facing surface of the corresponding recess portion 307 of the housing and cause the retention barb 309 and the terminal 302 to loosen relative to the housing.

SUMMARY OF THE INVENTION

An object of the present invention is to solve the above-mentioned problems in the conventional board-to-board connectors and to provide a reliable board-to-board connector pair in which first terminals each include a L-shaped contact portion and an inverted U-shaped retention portion integrally connected with the contact portion. The terminals are attached to a first connector housing by press-fitting them from the mating surface side. Inserting the terminals from this direction, or "top loading," can reduce the necessary mounting area of the connector, stabilize the overall position of the terminals, and reduce the likelihood of lifting the terminals which might otherwise occur at the time of unmating.

To achieve the above object, the present invention provides a board-to-board connector which comprises a first connector, including a receiving recess in which first terminals are disposed, and a side wall portion adjacent to one side of the insertion recess and a second connector, adapted to be mated with the first connector, and including an insertion projection on which second terminals to come into contact with the first terminals are disposed. The insertion projection of the second connector being inserted into the receiving recess of the first connector. The side wall portion includes a first-terminal fixing hole formed on a side toward the receiving recess and extending in the insertion direction of the insertion projection, and a housing reference surface including a surface of the first-terminal fixing hole away from the receiving recess and extending in the insertion direction of the insertion projection. Each of the first terminals includes an L-shaped contact portion and an inverted-U-shaped retention portion. The L-shaped first contact portion includes a first vertical portion, disposed on one side of the receiving recess away from the side wall portion and having a first projecting portion formed thereon and a second vertical portion, disposed on the opposite side of the receiving recess toward the side wall portion and having a second projecting portion formed thereon. The retention portion includes a terminal reference surface extending in the insertion direction of the insertion projection and formed along a side edge of the second vertical portion opposite the receiving recess. The terminal reference surface contacts the housing reference surface. A first leg portion having a distal end portion is press-fit into the first-terminal fixing hole. A second leg portion extending in the insertion direction cooperates with the first leg portion grasping the side wall portion Preferably, the second leg portion includes an engagement projection and the side wall portion includes an engagement portion formed on a side surface thereof opposite the receiving recess and coming into engagement with the engagement projection. The second leg portion may include a solder tail portion formed at a distal end thereof. When the insertion projection of the second connector is inserted into the receiving recess, each of the first terminals is elastically deformed and expanded to grip the insertion projection between the first projecting portion and the second projecting portion. The first connector includes grooves for receiving the first terminals. The first terminals are pressed-fit into the grooves in the insertion direction of the insertion projection.

A board-to-board connector for mating with another connector has a housing and a plurality of terminals. The terminals and housing interact at a reference surface to accurately locate the terminals relative to the housing. The housing includes an elongated recess that extends parallel to a longitudinal axis of the housing and has a plurality of terminal receiving cavities spaced therealong. Each cavity includes a terminal retention wall with a reference surface on one side thereof and a terminal alignment opening extending from the cavity. Each terminals is disposed in a terminal receiving cavity. Each terminal includes a U-shaped retention portion, an L-shaped resilient contact portion extending from the U-shaped retention portion and has a contact projection thereon. A tail portion for interconnection to a circuit member is also provided. The U-shaped retention portion includes first and second spaced apart legs and a connecting portion therebetween with the U-shaped retention portion dimensioned to securely receive the terminal retention wall of the housing between the spaced apart legs. The first leg is positioned along and engages the reference surface in order to accurately position the terminal within the terminal receiving cavity, and a terminal alignment projection extends from the U-shaped retention portion and projects into the terminal alignment opening to further position and secure the terminal within the cavity.

A portion of the terminal alignment opening may be collinear with the reference surface. In addition, the reference surface may be generally planar and face the recess. The terminal alignment projection may extend from the first leg of the U-shaped retention portion and may be press-fit within the terminal alignment opening. If desired, the terminal alignment opening may be configured as a bore that extends from the cavity to a mounting face of the connector. In one embodiment, the U-shaped retention portion may be an inverted U-shape and the second leg thereof may have a second projecting portion formed thereon generally facing the contact projection.

The first and second connectors are mated along a mating axis, and the first and second spaced apart legs and the terminal alignment projection may all be configured to be generally parallel to the mating axis. The second spaced apart leg may include an engagement projection and the terminal retention wall of the housing may include an engagement portion formed on a side surface thereof to engage the engagement projection when the terminal is fully inserted in the housing.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DESCRIPTION OF THE PREFERRED EMBODIMENT

Figure 1:
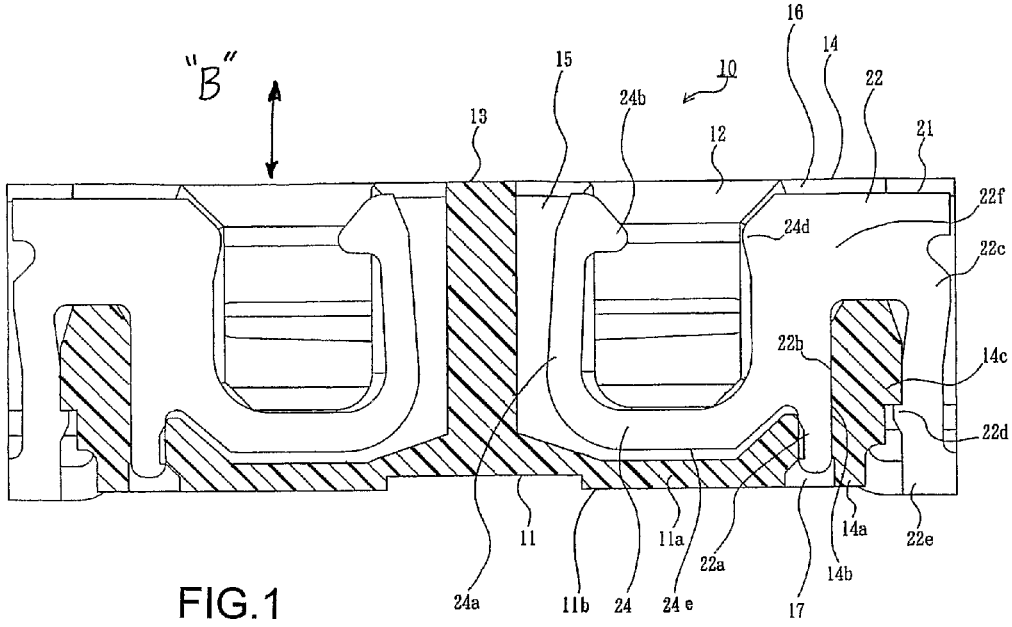
FIG. 1 is a sectional view (taken along line A-A in FIG. 2) of a first connector according to an embodiment of the present invention.

Referring to the drawings in greater detail, first connector 10 and second connector 30 are a pair of mating board-to-board connectors. These connectors are surface mount type connectors mounted on the surface of respective circuit boards or members 51, 52.

In the present embodiment, terms for expressing direction, such as up, down, left, right, front, and rear, are used for explaining the structure and action of respective portions of the board-to-board connectors. However, these terms represent respective directions for the case where the board-to-board connectors are used in an orientation shown in the drawings, and must be construed to represent corresponding different directions when the orientation of the board-to-board connectors is changed.

Figure 2:
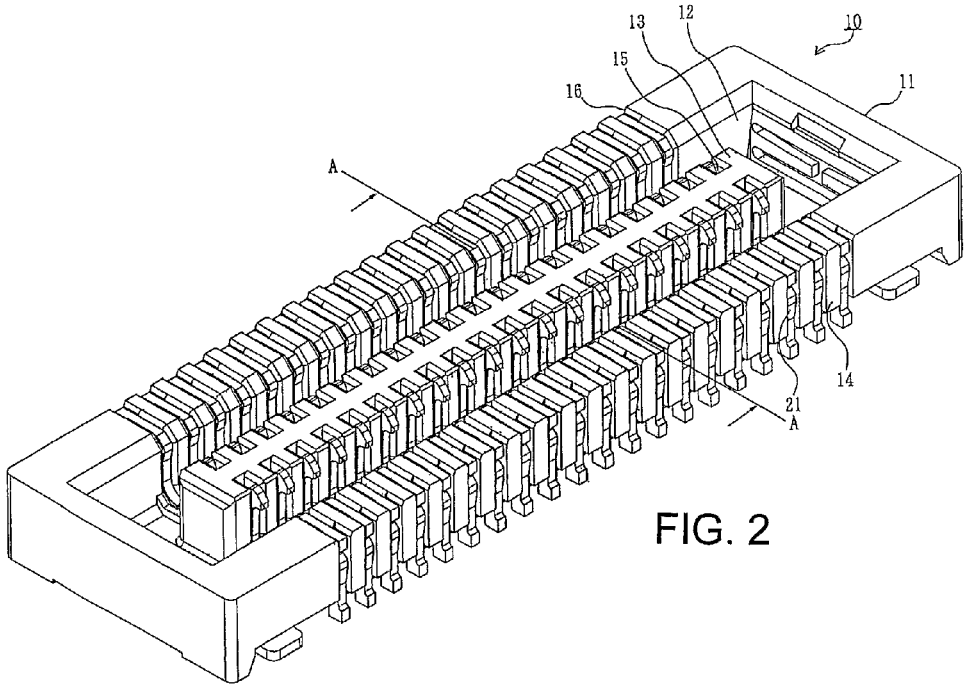
FIG. 2 is a perspective view of the first connector according to the embodiment.
Figure 3:
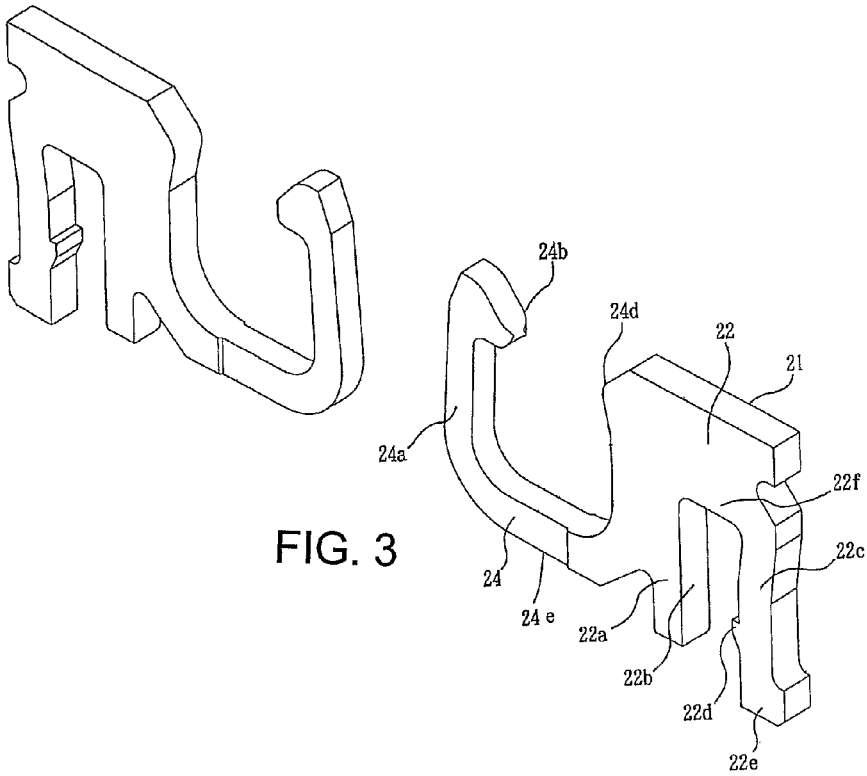
FIG. 3 is a perspective view of two terminals used in the first connector of FIGS. 1 and 2.

Referring to FIGS. 1-3, first connector 10 includes a first housing or connector main body 11 integrally formed from an insulative material such as a synthetic resin. As shown in FIG. 2, first housing 11 has a shape of a generally rectangular thick plate with a generally rectangular concave portion or slot formed in a mating surface into which second connector 30 is inserted. Although the first connector 10 has a length of about 12 mm, a width of about 3.5 mm and a depth of about 1.7 mm, the size can be changed freely. In the concave portion, a ridge portion or central projection 13 is formed integrally with the first housing 11. Side wall portions 14 extending parallel to the ridge portion 13 are formed integrally with the first housing 11 such that the side wall portions 14 are located on opposite sides of and spaced from the ridge portion 13. The ridge portion 13 and the side wall portions 14 project upwardly from the bottom surface of the concave portion and extend along the longitudinal direction of the first housing 11. Thus, an elongated groove portion or receiving recess 12, extending along the longitudinal direction of the first housing 11, is formed on both sides of the ridge portion 13 and each is thus located between the ridge portion 13 and the corresponding side wall portion 14. As shown in FIG. 1, the groove portion 12 is closed by a bottom wall portion 11*a* at the bottom which corresponds to the mounting surface 11*b* of the first housing 11 configured to be mounted on the circuit board 51. In the preferred embodiment, one ridge portion 13 is provided. However, a plurality of ridge portions may or no ridge portions be provided, and the number of the ridge portions is arbitrary. Although the ridge portion 13 has a width of about 0.8 mm, the size may be changed freely.

First-terminal receiving slots 15 or cavities for receiving first terminals 21 are formed such that they extend along the longitudinal axis of connector 10 on the opposite sides of ridge portion 13 and above bottom surfaces of the groove portions 12. In the preferred embodiment, twenty terminal receiving slots 15 are formed on each side of ridge portion 13 and above the bottom surface of the corresponding groove portion 12 at a pitch of about 0.4 mm. As depicted, twenty terminals 21 are accommodated within the twenty terminal receiving slots 15, at a pitch of about 0.4 mm. on each side of ridge portion 13. First-terminal receiving slots 15 include tapered lead-in surfaces or grooves 16 along the upper opening of such slots to facilitate insertion of terminals 21 within slots 15. The first-terminal receiving slots 15 and the first-terminal lead-in surfaces 16 are continuously and integrally formed as part of housing 11.

First-terminal alignment holes 17 are formed to extend from and be in communication with first terminal receiving slots 15 and penetrate the bottom wall 11*b* in the mating direction "B" (FIG. 1) of the mating connectors. A portion of an inner surface of each first-terminal alignment hole 17 and the inner side surface of the corresponding terminal engaging portions 14*a* are collinear and form a common flat surface 14*b* serving as a housing reference surface or datum. This reference surface 14*b*, is a reference for defining the positional relationship between the first housing 11 and the first terminals 21. As depicted, the housing reference surface 14*b* is planar and extends in the insertion direction of the insertion projections 32 which, in the described embodiment, is the same as mating direction B. Further, engagement portion or shoulder 14*c* for engagement with engagement projections 22*d* of the first terminals 21 is formed on the outer side surface of each engaging portion 14*a*.

The structure of first terminals 21 is shown in detail in FIGS. 1 and 3. Each of the first terminals 21 has a retention portion 22 and a contact portion 24, and is stamped or blanked from an electrically conductive metal sheet. As such, terminal 21 is generally or substantially planar with a thickness equal to the thickness of the sheet metal from which it is stamped. The retention portion 22 has an inverted-U-shaped profile, and includes a connecting or bridge portion 22*f*, and first and second, spaced apart leg portions 22*a* and 22*c*, which extend integrally from the connecting portion 22*f* toward the mounting surface 11*b* in the terminal insertion direction. The first leg portion 22*a* is located within housing 11 along reference surface 14*b* and the second leg portion 22*c* is located on the opposite side of terminal engaging portion 14*a* of the housing. The outer side surface of the first leg portion 22*a* is flat, and serves as a terminal reference surface 22*b*, which engages reference surface 14*b* to define the positional relationship between housing 11 and terminal 21. An engagement projection 22*d* for engagement with the engagement portion 14*c* of the first housing 11 is formed on the inner side surface of the second leg portion 22*c* which holds the terminal to the housing. A solder tail portion 22*e* is formed at the distal end of the second leg portion 22*c*. The solder tail portion 22*e* projects from the mounting surface 11*b* of the first housing 11 and its lower projection end surface is soldered to a conductive circuit or pad on the surface of the circuit board 51.

The contact portion 24 has a generally L-shaped profile with a first vertical portion 24*a*, located near ridge portion 13, and extending in the mating direction B. Vertical portion 24*a* is accommodated in the terminal accommodation slot 15 formed in a side surface of ridge portion 13. A bottom portion 24*e*, corresponding to the horizontal portion of the letter L, extends in the lateral direction. The first vertical portion 24*a* and bottom portion 24*e* combine to form a deflectable spring arm. A first contact portion 24*b* is formed in the vicinity of the upper end of the first vertical portion 24*a*, and a second projecting portion 24*d* is formed in the vicinity of the upper end of the first leg portion 22*a* of retention portion 22. The first and second projecting portions 24*b* and 24*d* project such that they face each other. The first and second projecting portions 24*b* and 24*d* are located at substantially the same position or height in the mating direction.

A path along the first terminal 21 extending from the lower end surface of the solder tail portion 22*e* to the first projecting portion 24*b* is long, and substantially cured. Therefore, the phenomenon of solder wicking is unlikely to occur. That is, there is little likelihood that solder will travel to the first projecting portion 24*b* from solder tail 22*e*.

Each terminal 21 is inserted into housing 11 from above the housing or "top loaded" as viewed in FIG. 1, into the corresponding first-terminal receiving slot 15 and the corresponding lead-in surfaces 16 so that the first leg portion 22*a* and the second leg portion 22*c* grip onto opposite sides of terminal engaging portion 14*a* to retain the first terminal 21 in housing 11. During assembly, each terminal 21 is moved from the mating surface of housing 11 in the direction in which the first and second leg portions 22*a* and 22*c* project. That is, each terminal 21 is moved downwardly in a position as shown in FIG. 3 and inserted into housing 11 from the upper side thereof in FIG. 1. Retention portion 22 is received in the corresponding groove 16 formed on the upper surface of the side wall portion 14, and the distal end portion of the first leg portion 22*a* is press-fit into the first-terminal alignment hole 17. The engagement projection 22*d* of the second leg portion 22*c* slides past and comes into engages the engagement portion 14*c* of the housing 11 preventing terminal 21 from being moved upwardly out of the housing 11.

When each terminal 21 is secured in housing 11, the bottom portion 24*e* of contact portion 24 is received in the first-terminal receiving slot 15 formed on the bottom surface of the corresponding groove portion 12. First projecting portion 24*b* projects from the first-terminal receiving slot 15 into the groove portion 12 and second projecting portion 24*d* is located in the first-terminal receiving slot 15. In such condition, terminal reference surface 22*b* is in contact with the housing reference surface 14*b* to accurately locate terminal 21 in relation to housing 11.

Contact portion 24 is resilient to permit mating and engagement with a mating connector 30. First vertical portion 24*a* and bottom portion 24*e* deform elastically when first connector 10 is mated with the second connector 30. Upon deflection, first projecting portion 24*b* is pushed toward the ridge portion 13. Contact portion 24 reacts by virtue of its resilient property so that the first projecting portion 24*b* and the second projecting portion 24*d* grip the second terminal 41 and the insertion projection 32, respectively. Retention portion 22 grips the terminal engaging portion 14*a* from both sides by gripping it between the first leg portion 22*a* and the second leg portion 22*c*. The cantilevered tip end portion of the first leg portion 22*a* is press fit into the first-terminal alignment hole 17. Therefore, even when the contact portion 24 engages second connector 30 and elastically deforms, retention portion 22 does not deform, and the terminal reference surface 22*b* does not bend, deflect or more relative to housing 11. Through such a configuration, uniform contact can be maintained between the terminal reference surface 22*b* and housing reference surface 14*b*, and the overall position of each first terminal 21 can be ensured.

An additional feature of the disclosed embodiment is that first terminals 21 are not exposed at the lower surface of the first connector 10, except for the solder tail portions 22*e*. The groove portions 12 are closed by the bottom wall portions 11*a* on the mounting surface side. Therefore, conductive circuits can be located on a surface of the circuit board 51 under the lower mating surface 11*b* of the first connector housing 11.

The contact pressure generated when the first contact portion 24*b* of contact portion 24 comes into contact with the contact portion 44*b* of the second terminal 41 is not transmitted to the engagement projection 22*d* or the solder tail portion 22*e* of the retention portion 22. Therefore, even when the first connector 10 and the second connector 30 are mated, force is not transferred to the solder joint between the solder tail portion 22*e* and the circuit board 51, thus reducing the likelihood of cracks at the solder joint.

Figure 4:
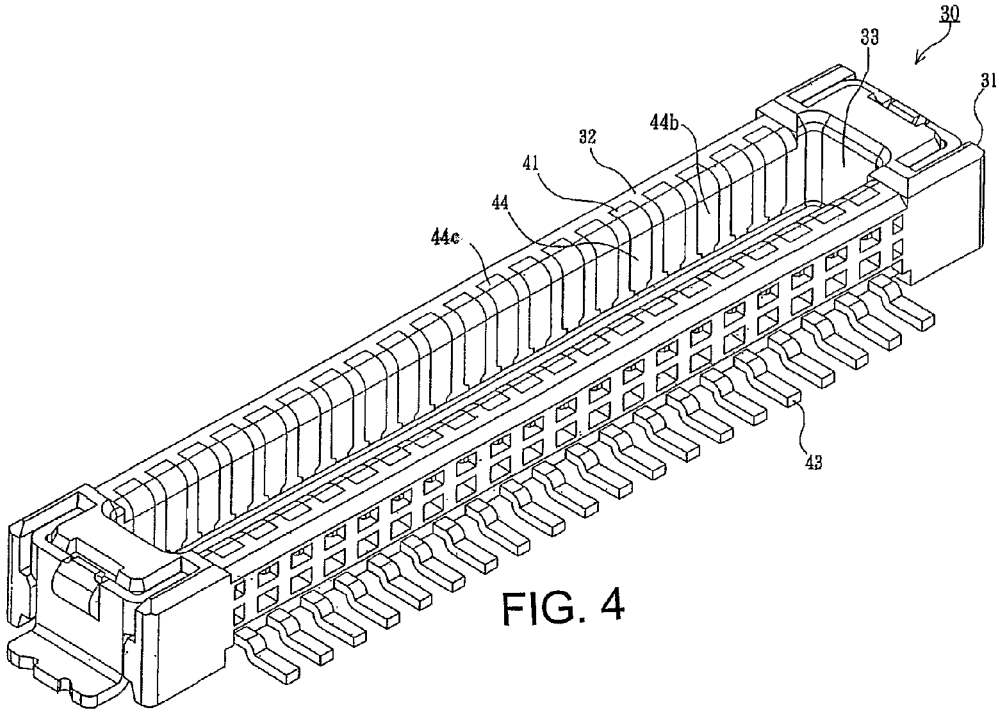
FIG. 4 is a perspective view of a second connector for mating with the connector of FIGS. 1 and 2.

FIG. 4 is a perspective view of a second, mating connector 30 which includes a second housing or connector main body 31 integrally formed from an insulative material such as a synthetic resin. As shown in FIG. 4, housing 31 has a shape of a generally rectangular thick plate with a length of about 10 mm, a width of about 3 mm, and a thickness of about 1.1 mm. However, the size can be changed freely. Housing 31 has a pair of integrally formed longitudinal side walls 32 that project upwardly from its base and a pair of end walls at opposite ends of the sidewalls. The sidewalls and end walls define an elongated grove portion 33 extending in the longitudinal direction of the second housing 31. In the disclosed embodiment, there are two sidewalls 32 that act as insertion projections for inserting into recesses 12 of first connector 10. However, a single insertion projection or three or more insertion projections may be provided by modifying the housing. Although the groove portion 33 has a width of about 0.8 mm, the size may be changed freely.

The second housing 31 is formed through over-molding to partially cover second terminals 41 in resin. The second contact portion 44 of each second terminal 41 is embedded in the sidewalls or insertion projections 32 such that, as shown in FIG. 4, the surface of the contact portion 44 is exposed at the inner side surface 44*b* and the intermediate surface 44*c*, as shown as a top surface in FIG. 4, of the insertion projection 32. Each of the second terminals 41 has a solder tail portion 43 extending outwardly from the lower edge of one of the opposite sides of the second housing 31. In the disclosed embodiment, twenty terminals 41 are disposed at a pitch of about 0.4 mm on each side. However, the pitch and the number of second terminals 41 may be changed as desired.

Figure 5:
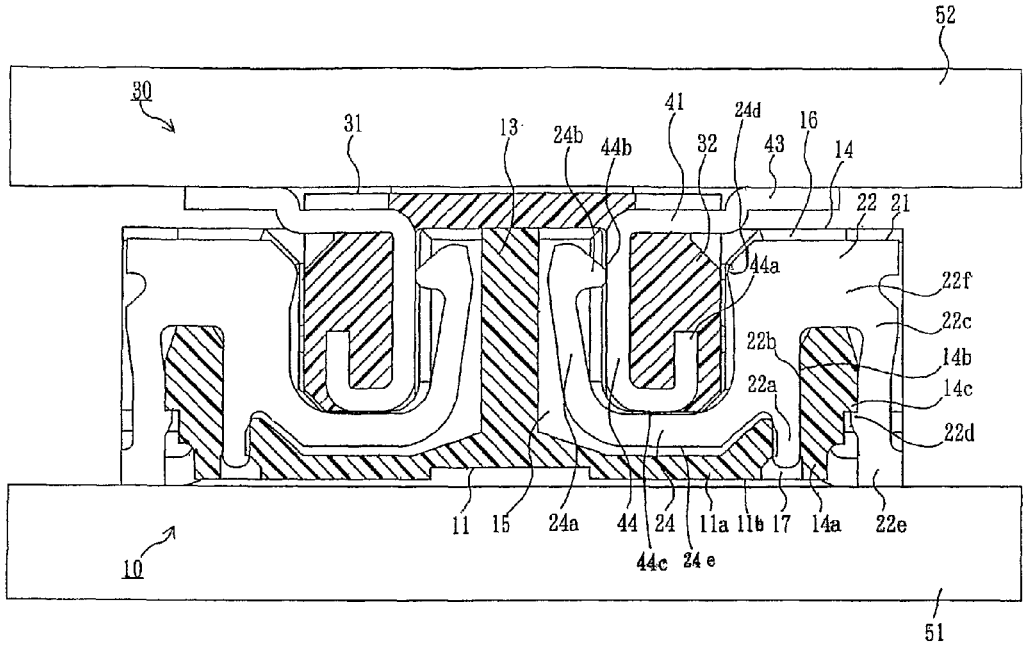
FIG. 5 is a sectional view showing a state in which the first and second connectors are mated together.
Figure 6:
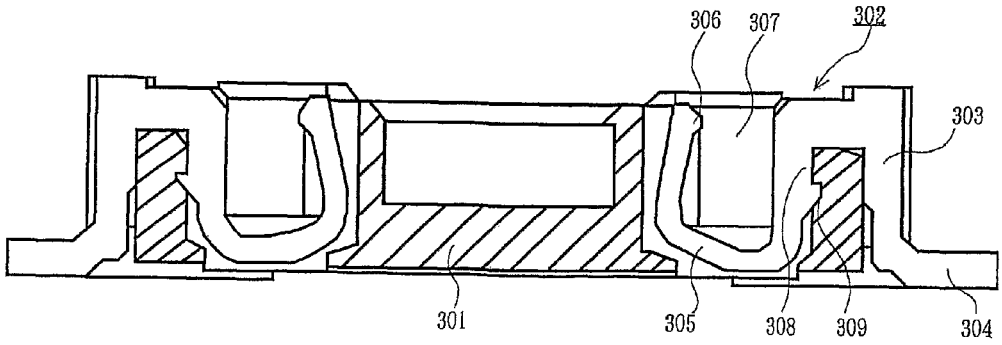
FIG. 6 (Prior art)
FIG. 6 is a sectional view of a prior art board-to-board connector.

FIG. 5 is a sectional view showing a state in which the first and second connectors are mated together while they are mounted to their respective printed circuit boards 51, 52. Each second terminal 41 has a solder tail portion 43 and a contact portion 44, and is stamped and formed from electrically conductive sheet metal. The contact portion 44 has a generally J-shaped profile, and has a vertically extending side wall portion 44*b* having a surface exposed at the inner side surface of the insertion projection 32 in groove portion 33 and a vertically extending distal end portion 44*a* which is embedded in the sidewall or insertion projection 32. Since the distal end portion 44*a* is embedded in the insertion projection 32, second terminal 41 is strongly secured within second housing 31. An intermediate portion 44*c* between the side wall portion 44*b* and the distal end portion 44*a* extends in the lateral direction and is exposed at the top surface (when viewed in FIG. 4) of insertion projection 32. The inner end (on the side toward the groove portion 33) of the solder tail portion 43 is connected to the upper end of the second connection portion 44, and extends in the lateral direction. Solder tail portion 43 is configured to be soldered to a conductive circuit or pad (not shown) formed on the surface of the circuit board 52.

The surface of the side wall portion 44*b* of the contact portion 44 serves as a contact for contacting the first projecting portion 24*b* of a corresponding first terminal 21. When the first connector 10 is mated with the second connector 30, the first projecting portion 24*b* of the first terminal 21 comes into contact with the flat contact portion 44*b* of the contact portion 44. Since the contact portion 44*b* of the contact portion 44 extends vertically, the first projecting portion 24*b* can continuously wipe the surface of the contact portion 44*b* to thereby produce a sufficient level of wiping effect which is especially important with miniature connectors. Thus, good electrical connection between the first projecting portion 24*b* and the contact portion 44 is likely.

Since the second housing 31 is formed through over-molding and covers the joint between the solder tail portion 43 and contact portion 44, solder is unlikely to travel along the second terminal 41 from solder tail portion 43 to the surface of the contact portion 44*b* during the soldering process.

Prior to mating, the first connector 10 and the second connector 30 are positioned such that the mating surface of the first connector 10 and the mating surface of the second connector 30 directly face each other. In this state, the mating surface of the first connector 10 and the mating surface of the second connector 30 are generally parallel to each other, and the circuit board 51 carrying the first connector 10 and the circuit board 52 carrying the second connector 30 are also generally parallel to each other. The first connector 10 and the second connector 30 are moved relatively towards each other whereby they are mated with each other as shown in FIG. 5. During mating, ridge portion 13 of first connector 10 is inserted into groove portion 33 of second connector 30, and the insertion projections or sidewalls 32 of second connector 30 are inserted into the corresponding groove portions 12 of first connector 10.

As a result, the first projecting portion 24*b* of contact portion 24 of each first terminal 21 engages the contact 44*b* of the contact portion 44 of the corresponding second terminal 41. In addition, second projecting portion 24*d* of contact portion 24 of each first terminal 21 engages the outer side surface of the insertion projection 32. FIG. 5 shows a gap present between the second projecting portion 24*d* and the outer side surface of the insertion projection 32 for the sake of clarity.

In the disclosed embodiment, the distance between the facing surfaces of the first and second projecting portions 24*b* and 24*d* of contact portion 24 of each first terminal 21 is shorter than the distance between the contact 44*b* of the contact portion 44 of each second terminal 41 and the outer side surface of the insertion projection 32. As a result of mating of the first connector 10 and the second connector 30 together, the insertion projections 32 of the second connector 30 are inserted into the corresponding groove portions 12 of the first connector 10, thus deflecting the spring arm of contact portion 24 and increasing the distance between the facing surfaces of the first and second projecting portions 24*b* and 24*d* of first terminal 21. Therefore, the insertion projections 32 to which the second terminals 41 are mounted are gripped by the first projecting portions 24*b* of the first vertical portions 24*a* and the second projecting portions 24*d* of the first leg portion 22*a*. The end of the first projecting portion 24*b* of the contact portion 24 of each first terminal 21 engages contact 44*b* of the contact portion 44 of the corresponding second terminal 41.

Further, when each of the insertion projections 32 of the second connector 30 is inserted into the corresponding groove portion 12 of the first connector 10, the tip portion of the first projecting portion 24*b* of the first connection portion 24 of the first terminal 21 moves while sliding along the flat surface of the contact portion 44*b*. Therefore, a scraping or wiping effect is produced, so that substances which hinder electrical continuity, such as dust and oxides adhering to the tip end of the first projection portion 24*b* and the surface of the contact portion 44*b*, are removed through wiping. Therefore, reliable electrical continuity is secured at the contact portion.

When disengaging the first connector 10 from the second connector 30, the first connector 10 and the second connector 30 are pulled away from each other. As a result, the insertion projections 32 of the second connector 30 are pulled upwardly from the respective groove portions 12 of the first connector 10, while being gripped by the first projecting portion 24*b* and the second projecting portion 24*d* of the first connection portion 24 of each first terminal 21. An upwardly pulling force acts on the first projecting portion 24*b*, and a rotational moment acts on the contact portion 24 to attempt to separate such that the terminal reference surface 22*b* from housing reference surface 14*b*. However, since the tip end portion of the first leg portion 22*a* is press-fit into the first-terminal alignment hole 17, the retention portion 22 does not elastically deform, and the terminal reference surface 22*b* is not displaced relative to reference surface 14*b*. Therefore, the overall position of the first terminal 21 is very stable, even during mating and unmating.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A board to board connector adapted to be mated with a second connector, comprising:

an elongated insulative housing, the elongated insulative housing including an elongated recess extending parallel to a longitudinal axis of the elongated insulative housing and with a plurality of terminal receiving cavities spaced therealong, each terminal receiving cavity including a terminal retention wall with a reference surface on one side thereof and a terminal alignment opening extending from the terminal receiving cavity;

a plurality of conductive terminals, each conductive terminal being disposed in one of the terminal receiving cavities and including a U-shaped retention portion, an L-shaped resilient contact portion extending from the U-shaped retention portion and having a contact projection thereon and a tail portion for interconnection to a circuit member, the U-shaped retention portion including first and second spaced apart legs, a connecting portion therebetween and a terminal alignment projection adjacent the tail portion, the U-shaped retention portion being dimensioned to securely receive the terminal retention wall between the spaced apart legs, the first leg being positioned along and engaging the reference surface in order to accurately position the conductive terminal within one of the terminal receiving cavities and the terminal alignment projection extending from the U-shaped retention portion and projecting into the terminal alignment opening to further position and secure one of the conductive terminal within the terminal receiving cavities.

2. The board to board connector of claim 1, wherein a portion of the terminal alignment opening is collinear with the reference surface.

3. The board to board connector of claim 1, wherein the reference surface is generally planar and faces the elongated recess, and a portion of the terminal alignment opening is collinear with the generally planar reference surface, and the terminal alignment projection extends from the first leg of the U-shaped retention portion and is press-fit within the terminal alignment opening.

4. The board to board connector of claim 3, wherein the terminal alignment opening is a bore that extends from the terminal receiving cavity to a mounting face.

5. The board to board connector of claim 1, wherein the U-shaped retention portion is an inverted U-shape and the second leg has a second projecting portion formed thereon generally facing the contact projection.

6. The board to board connector of claim 4, wherein the U-shaped retention portion is an inverted U-shape and the second leg has a second projecting portion formed thereon generally facing the contact projection.

7. The board to board connector of claim 1, wherein the first and second connectors are mated along a mating axis, and the first and second spaced apart legs and the terminal alignment projection are all generally parallel to the mating axis.

8. The board to board connector of claim 5, wherein the first and second connectors are mated along a mating axis, and the first and second spaced apart legs and the terminal alignment projection are all generally parallel to the mating axis.

9. The board to board connector of claim 1, wherein the second spaced apart leg includes an engagement projection and the terminal retention wall includes an engagement portion formed on a side surface thereof to engage the engagement projection when the conductive terminal is fully inserted in the elongated insulative housing.

10. The board to board connector of claim 8, wherein the second spaced apart leg includes an engagement projection and the terminal retention wall includes an engagement portion formed on a side surface thereof to engage the engagement projection when the conductive terminal is fully inserted in the elongated insulative housing.

11. A board to board connector for mating with a second connector along a mating axis, comprising:

an elongated insulative housing, the elongated insulative having a mating face, an oppositely facing mounting face and an elongated recess extending parallel to a longitudinal axis of the elongated insulative housing and with a plurality of terminal receiving cavities spaced therealong, each terminal receiving cavity including a terminal retention wall with a reference surface on one side thereof facing the elongated recess and a terminal alignment opening extending from the terminal receiving cavity;

a plurality of conductive terminals, each conductive terminal being disposed in one of the terminal receiving cavities and including an inverted U-shaped retention portion, an L-shaped resilient contact portion and a solder tail portion, the inverted U-shaped retention portion including first and second spaced apart legs, a connecting portion therebetween and a terminal alignment projection adjacent the solder tail portion, the U-shaped retention portion being dimensioned to securely receive the terminal retention wall between the spaced apart legs, the first leg being positioned along and engaging the reference surface in order to accurately position the conductive terminal within the terminal receiving cavity, the L-shaped resilient contact portion extending from the first leg of the inverted U-shaped retention portion and having a contact projection thereon, the solder tail portion extending from a distal end of the second leg of the inverted U-shaped retention portion for interconnection to a circuit member, and the terminal alignment projection extending from the U-shaped retention portion and projecting into the terminal alignment opening to further position and secure the conductive terminal within one of the terminal receiving cavities.

12. The board to board connector of claim 11, wherein the reference surface is generally planar, and a portion of the terminal alignment opening is collinear with the generally planar reference surface, and the terminal alignment projection extends from the first leg of the U-shaped retention portion and is press-fit within the terminal alignment opening.

13. The board to board connector of claim 12, wherein the terminal alignment opening is a bore that extends from the terminal receiving cavity to the mounting face of.

14. The board to board connector of claim 11, wherein the second leg has a second projecting portion formed thereon generally facing the contact projection.

15. The board to board connector of claim 11, wherein the first and second spaced apart legs and the terminal alignment projection are all generally parallel to the mating axis.

16. The board to board connector of claim 11, wherein the second spaced apart leg includes an engagement projection and the terminal retention wall includes an engagement portion formed on a side surface thereof to engage the engagement projection when the conductive terminal is fully inserted in the elongated insulative housing.

* * * * *